US005197624A

United States Patent [19]

Dodaro

[11] Patent Number: 5,197,624

[45] Date of Patent: Mar. 30, 1993

[54] CUP LID

[75] Inventor: Tony Dodaro, Scarborough, Canada

[73] Assignee: M&N Plastics, Inc., Tampa, Fla.

[21] Appl. No.: 839,939

[22] Filed: Feb. 21, 1992

Related U.S. Application Data

[63] Continuation-in-part of Ser. No. 729,395, Jul. 12, 1991, abandoned, which is a continuation-in-part of Ser. No. 676,324, Feb. 28, 1991.

[51] Int. Cl.[5] ..... B65D 41/56

[52] U.S. Cl. ..... 220/254; 220/269; 220/712; 229/906.1

[58] Field of Search ..... 220/254, 269, 711, 712, 220/713; 229/906.1

[56] References Cited

U.S. PATENT DOCUMENTS 4,202,459 5/1980 DeParales et al. ..... 220/712
4,473,167 9/1984 Bailey ..... 220/712
4,629,088 12/1986 Durgin ..... 220/254
4,738,373 4/1988 DeParales ..... 220/254

*Primary Examiner*—Stephen Marcus
*Assistant Examiner*—Nova Stucker
*Attorney, Agent, or Firm*—Arthur W. Fisher, III

[57] ABSTRACT

A cup lid for use with a beverage cup comprising a peripheral flange to fit over a cup rim and a central portion containing a reclosable access closure flap selectively movable between an open and closed position having a pull tab formed on one end portion thereof and a hinge formed on the opposite end portion thereof and a first retainer element such that when the reclosable access closure flap is moved from the closed position to the open position the reclosable access closure flap engages the first retainer element to releasably retain the reclosable access closure flap in the open position.

12 Claims, 3 Drawing Sheets

CUP LID

CROSS-REFERENCE

This application is a continuation-in-part application of pending application Ser. No. 729,395 filed Jul. 12, 1991 now abn that is a continuation-in-part application of application Ser. No. 676,324, filed Feb. 28, 1991, pending.

BACKGROUND OF THE INVENTION

1. Field of the Invention

A cup lid comprising a reclosable access closure flap selectively movable between a closed and open position and a first retainer element disposed to engage the reclosable access closure flap when in the open position to releasably retain the reclosable access closure flap in the open position.

2. Description of the Prior Art

Cuplike containers for coffee, soft drinks or other beverages often are provided with lids to cover the contents before and during use. Such lids may thermally insulate the contents and assist to exclude dust, hair, insects, leaves or other contaminants. Lids to cover such contents usually are flanged peripherally to fit down over the cup rim, which is often rolled or beaded to retain the lid securely but removably. Simple or multiple recessing of one or more regions of laminar lids is commonly practiced for structural reinforcement of what otherwise would be too flexible for the desired use.

Consumers often prefer to access the contents with minimal disruption of the lid so as to maintain such protection as long as desired. Hence, such lids often include openable access closures, whether integrally formed or added thereonto. Such access closures often include part of the flange that mates the lid to the cup rim.

Because throw away items pollute the environment, the popularity of non-removable access closures is increasing. However, some captive closures have the disadvantage of being obtrusive when open, or failing to stay shut when reclosed. Favored are access closures, integral with the lid, that stay open when opened and stay shut whenever reclosed. Reclosable access closures with various means for holding them in a fully open position are disclosed in various prior art.

U.S. Pat. No. 4,322,015 discloses a pair of tear impressions that define an access strip therebetween. After assembly of the lid on a container, the access strip is pulled back from the rim of the lid along the tear impressions to create ready access to the contents. The access strip may be reclosed to the container to prevent spillage during transport or motion of the container and further to preserve the thermal state of the contents U.S. Pat. No. 4,473,167 teaches a polymeric container lid comprising a reclosable access strip defined between a pair of spaced apart tear impressions extending inwardly from the edge of the lid into the central portion thereof and a self-forming hinge element for the access strip together with a hold-open retainer by which the access strip can be releasably retained in the open condition.

U.S. Pat. No. 3,994,411 shows a lid for drink cups including a drinking flap of limited circumferential extent that may be pivotally opened and closed. The drinking flap may initially be defined by frangible lateral edges in the lid and may be held in the open position by the pull tab on the flap being inserted in a slit for a straw orifice.

U.S. Pat. No. 4,202,459 teaches a disposable cup cover including a separable pie shaped mouth piece which a user can bend out of the way in order to drink from the cup with an edge that will mate with a slot and to hold the mouth piece until it is desired to close the cover again.

U.S. Pat. No. 4,741,450 discloses a lid for a drinking cup or other container wherein the lid has a restricted opening through which the contents of the container may be drunk while leaving the lid in position to prevent spillage. The opening is covered by a flap which may be integral with the lid and separated therefrom by break or tear lines. The flap when folded back on the hinged line opposite the rim of the lid to reveal the opening, is automatically caught against the outer surface of the lid away from the opening so that it will not interfere with drinking from the cup and so that any reason for tearing off the flap and discarding it separately from the cup is removed.

An additional example of the prior art is found in U.S. Pat. No. 4,629,088 and U.S. Pat. No. 4,738,373.

SUMMARY OF THE INVENTION

A primary object of the present invention is to improve access closure hold-open operation and structure in a cup lid.

Another object of this invention is to render a cup lid closure more compact, leaving the central portion of the lid unimpeded when the closure flap is in the fully open position.

A further object of the invention is to improve the convenience with which an access closure flap is opened to a fully open position and alternatively is reclosed to a closed position.

In general, the objects of this invention are accomplished in a reclosable multilateral access closure flap of a generally laminar lid structure flanged peripherally so as to fit over a cup rim. The closure flap has an openable end portion including part of the flanged outer edge and an integral outer end tab. The flap has a pair of side edges slitted at least in part from the ends of the flanged edge to the ends of a transverse line, which defines the innermost end of the flap, at its junction to the rest of the lid, and constitutes a straight-line locus about which the flap pivots open.

More particularly, such an access closure flap preferably comprises a partial sector of the lid, joining the rest of the sector truncated along such pivot line, about which such access closure flap folds pivotally upward and backward through about a half circle of arc, until its free end lodges disengageably under a overhang on a non-recessed central portion of the lid, such as a vent cap.

Other objects of the present invention, together with means and methods for attaining the various objects, will be apparent from the following description and accompanying diagrams of preferred embodiment, which are presented by way of example rather than limitation.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
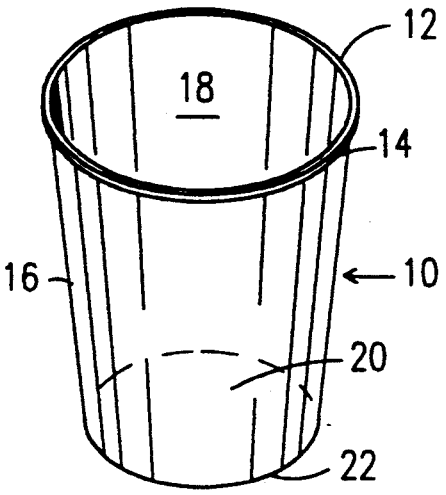
FIG. 1 is a perspective view of a beverage cup for use with the cup lid of the present invention.

FIG. 1 shows a beverage cup generally indicated as 10 with which the cup lid of the present invention is configured to be used. The beverage cup 10 comprises an upper rim 12 having a rolled or beaded top edge 14 formed thereon, a frustoconical body 16 with an interior 18 and a substantially flat base 20 inset or recessed upwardly from a bottom edge or rim 22.

Figure 2:
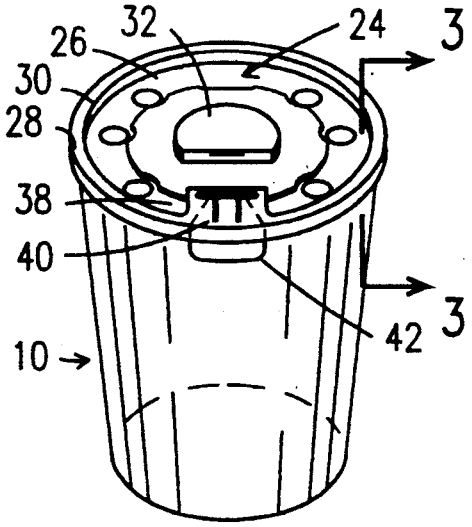
FIG. 2 is a perspective view of the beverage cup with the cup lid of the present invention.

As shown in FIG. 2, the beverage cup 10 is covered by the cup lid generally indicated as 24. The cup lid 24 comprises a substantially flat recessed portion 26 having a peripheral flange 28 formed about the peripheral edge 30 thereof, a centrally disposed substantially cylindrical projection 32 including a first retainer element or protrusion 34 extending outwardly from a flat surface 36 formed on the side thereof and a raised flap portion 38 having a reclosable access closure flap 40 including a pull tab 42 extending from the peripheral flange 28.

Figure 3:
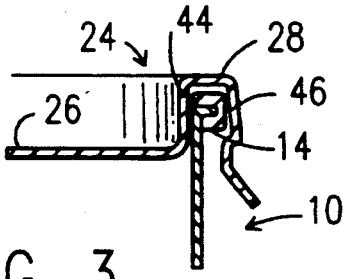
FIG. 3 is a partial vertical sectional elevation of the rim of the beverage cup and the adjacent peripheral lid flange taken along line 3—3 of FIG. 2.

As shown in FIG. 3, the peripheral flange 28 includes an inner and outer concentrically disposed wall indicated as 44 and 46 respectively cooperatively forming a groove or recess 48 to operatively receive the rolled or beaded top 14 when cup lid 24 is mounted on the beverage cup 10. As shown, the substantially flat recessed portion 26 is disposed below the upper rim 12.

Figure 4:
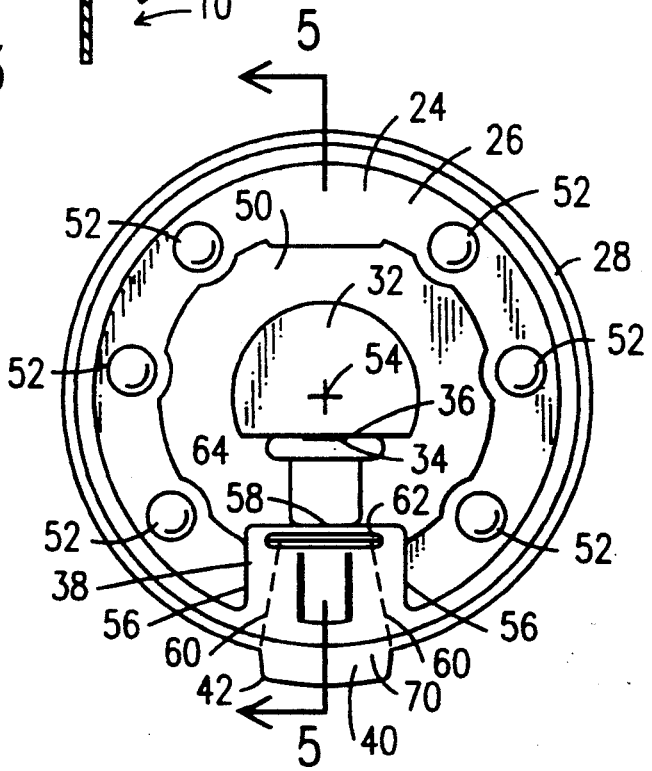
FIG. 4 is a top plan view of the cup lid with the reclosable access closure flap in the closed position.

As shown in FIG. 4, the substantially flat recessed portion 26 has a slight, substantially circular downward offset portion 50 interrupted by the raised flap portion 38 punctuated by a plurality of raised offsets each indicated as 52 adapted to be punched out to indicate the specific contents such as the type of drink or other contents. A pair of crossed slits 54 are formed in the centrally disposed substantially cylindrical projection 32 to function as a vent and beverage straw entry site when reclosable access closure flap 40 is in the closed position.

As best shown in FIG. 4, the raised flap portion 38 includes a pair of substantially parallel side edges each indicated as 56 extending from the peripheral flange 28 to an inner edge 58 disposed substantially perpendicular thereto and parallel to and spaced relationship relative to the flat surface 36. The reclosable access closure flap 40 is integral with and occupies the major part of the raised flap portion 38.

Figure 5:
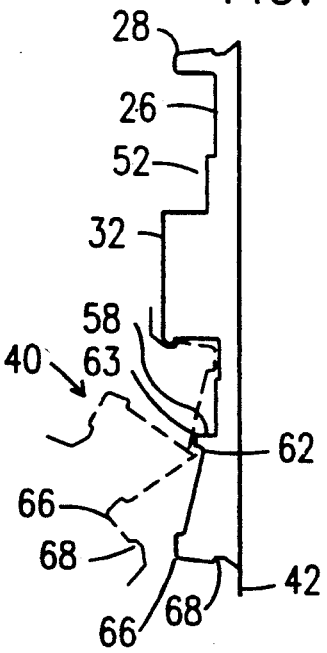
FIG. 5 is a schematic side elevation of the cup lid taken along line 5—5 of FIG. 4 with the reclosable access closure flap in the closed position.

The reclosable access closure flap 40 includes a closure flap opening means comprising a pair of straight flap access side edges each indicated as 60, each formed by a plurality of aligned short slits extending inwardly from the peripheral flange 28 to a hinge formed by a depression 62 substantially parallel to the inner edge 58. As best shown in FIG. 5, a bias ramp or ridge 63 is formed on the inner edge 58 between the hinge 62 and the first retainer element or protrusion 34. The bias ramp or ridge 63 is disposed above the hinge 62 in the horizontal plane to bias the reclosable access closure flap 40 in a closing direction when in the fully open position In addition, the hinge 62 may be disposed below the first retainer element or protrusion 34 in the horizontal plane. The flap access side edges 60 preferably comprise narrow lateral interconnections spaces between the slits readily broken as the reclosable access closure flap 40 is initially opened. A flap receiving recess 64 slightly offset below the plane of the substantially flat recess portion 26 is formed adjacent the first retainer element or protrusion 34.

FIG. 5 shows the cup lid 24 with the reclosable access closure flap 40 in successive positions when moved from the closed to fully open position indicated in broken lines. In the fully open position, the reclosable access closure flap 40 has swung through an arc of substantially 180 degrees until the outermost portion or second retainer element 66 of the peripheral flange 28 is disposed beneath the first retainer element or protrusion 34 to hold the reclosable access closure flap 40 in the fully open until subsequently released by means of the pull tab 42. Alternately the second retainer element may comprise a retainer recess or groove 68 formed in the outer concentrically disposed wall 46 to operatively receive the first retainer element 36 therein when the reclosable access closure flap 40 is fully open position The pull tab 42 is disposed above the top of the centrally disposed substantially cylindrical projection 32 to facilitate gripping of the pull tab 42 to reclose the reclosable access closure flap 40 as described more fully hereinafter.

Figure 6:
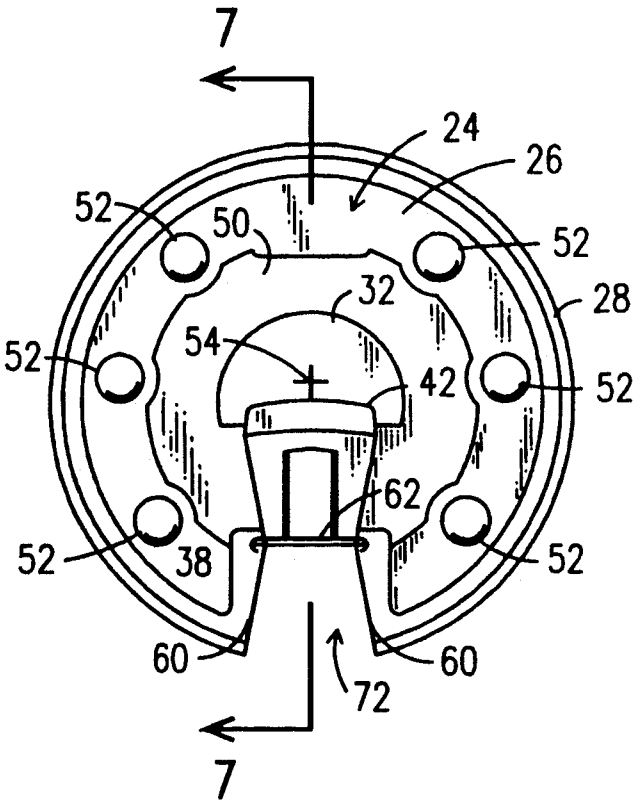
FIG. 6 is a top plan view of the cup lid with the reclosable access closure flap in the fully open position.

FIG. 6 shows the cup lid 24 with the reclosable access closure flap 40 in the fully open position.

It is readily apparent from the foregoing views that the reclosable access closure flap 40 is retained in the fully open position by engagement of the second retainer element 66 or 68 with the first retainer element or protrusion 34 rather than by the vent cap and/or one or more protrusions from the recessed portion of the lid, as sometimes was done in the prior art. The pull tab 42 is disposed substantially parallel to the top surface of centrally disposed substantially cylindrical projection 32 in spaced relationship relative thereto so that the pull tab 24 can be readily gripped to reclose the reclosable access closure flap 40 whenever desired.

Figure 7:
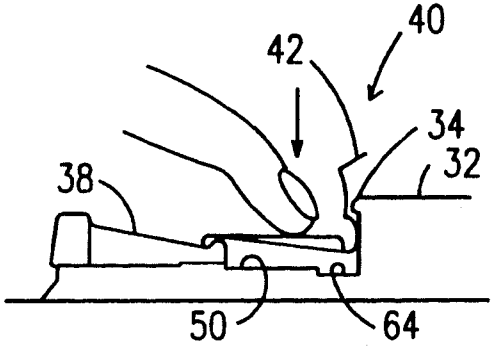
FIG. 7 is a partial side elevation of the cup lid with the reclosable access closure flap approaching the fully open position.
Figure 8:
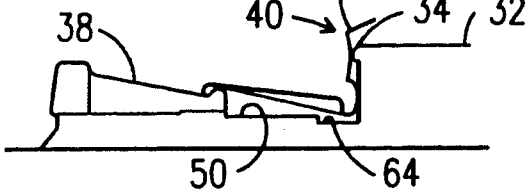
FIG. 8 is a partial side elevation of the cup lid with the reclosable access closure flap in the fully open position.
Figure 9:
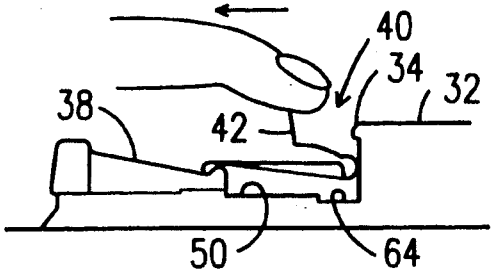
FIG. 9 is a partial side elevation of the cup lid with the reclosable access closure flap being disengaged to return to the closed position.

FIGS. 7 through 9 resemble FIG. 5 but show separately on an enlarged scale the novel interaction between the reclosable access closure flap 40 and the first retainer element or protrusion 34 during the opening and reclosing of the reclosable access closure flap 40. These FIGS. illustrate, respectively, the reclosable access closure flap 40 just before reaching the fully open position when being opened, the fully opened position and the disengaging position of the reclosable access closure flap 40 preparatory to being reclosed. To be opened, the pull tab 42 is gripped between thumb and forefinger (not shown) and pulled up to release the peripheral flange flap portion generally indicated as 70 of the peripheral flange 48 on the reclosable access closure flap 40 from the rolled or beaded edge 14 to break the flap access side edges 60. As the reclosable access closure flap 40 approaches an upright position the thumb or a forefinger conveniently slides to the under surface thereof and pushes downward.

FIG. 7 shows the conformation of the cup lid 24 of this invention when the outermost portion 66 of the peripheral flange flap portion 70 of the reclosable access closure flap 40 contacts the flat surface 36 adjacent the first retainer element or protrusion 34 during the opening procedure. Continuing pressure indicated by arrow and finger on the reclosable access closure flap 40 flexes the peripheral flange flap portion 70 of the reclosable access closure flap 40 to lessen the radius of curvature until the pull tab 42 is tilted obliquely away from the top of the first retainer element enabling the peripheral flange flap portion 70 to clear the first retainer element 34 whereupon the reclosable access closure flap 40 can reach the fully open position.

FIG. 8 shows that, in the fully opened position, the reclosable access closure flap 40 is essentially straight with the peripheral flange flap portion 70 engaging the first retainer element or protrusion 34, flat surface 32 and flap receiving recess 64.

FIG. 9 shows that reclosing the reclosable access closure flap 40 is simply a matter of pulling the pull tab 42 toward the access opening 72. The peripheral flange flap portion 70 flexes, lessening the radius of curvature to readily disengage the first retainer element or protrusion 34 whereupon the reclosable access closure flap 40 can be folded down toward the closed position such that the peripheral flange flap portion 70 may be resealed on the rolled or beaded top edge 14 to fully reclose the reclosable access closure flap 40.

Figure 10:
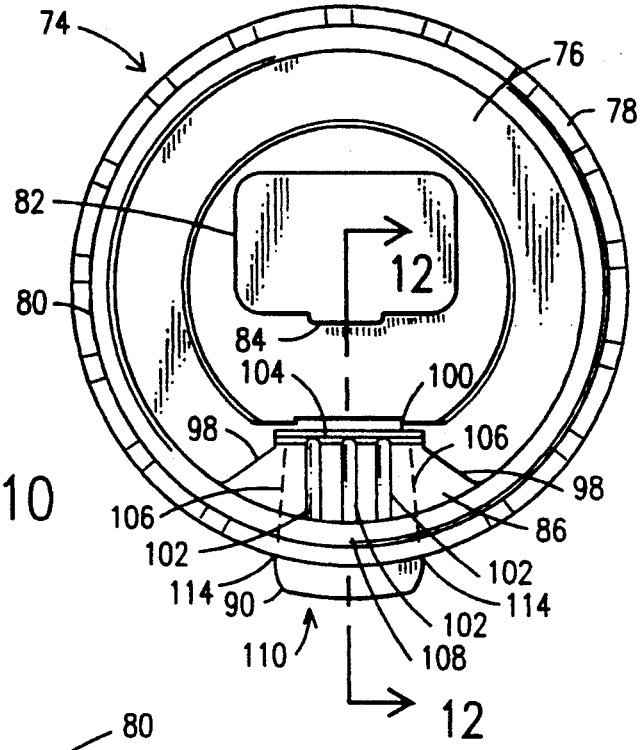
FIG. 10 is a top plan view of an alternate embodiment of the cup lid with the reclosable access closure flap in the closed position.
Figure 11:
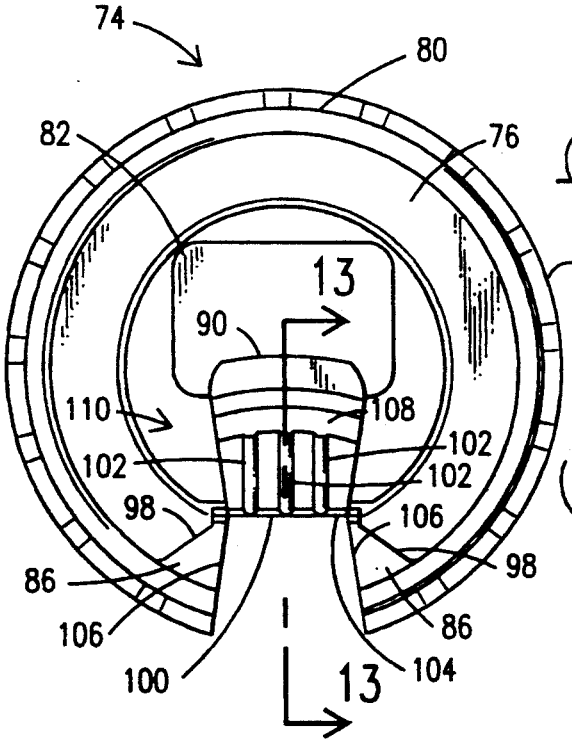
FIG. 11 is a top plan view of the alternate embodiment of the cup lid with the reclosable access closure flap in the fully open position.

FIGS. 10 through 13 show an alternate embodiment of the present invention. Specifically as shown in FIGS. 10 and 11, the cup lid generally indicated as 74 comprises a substantially flat recessed portion 76 having a peripheral flange 78 formed about the peripheral edge 80 thereof, a centrally disposed projection 82 including a first retainer element or protrusion 84 extending outwardly therefrom and a raised flap portion 86 having a reclosable access closure flap 88 including a pull tab 90 extending from the peripheral flange 78.

Figure 12:
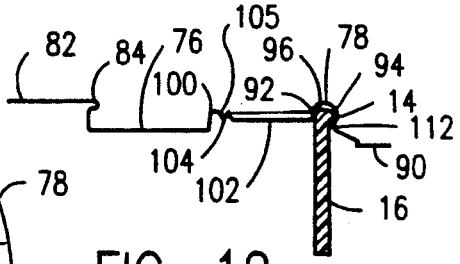
FIG. 12 is a partial sectional elevation of the alternate embodiment of the cup lid taken along line 12—12 of FIG. 10 with the reclosable access closure flap in the closed position.

As shown in FIG. 12, the peripheral flange 78 includes an inner and outer concentrically disposed wall indicated as 92 and 94 respectively cooperatively forming a groove or recess 96 to operatively receive the rolled or beaded top 14 when cup lid 74 is mounted on the beverage cup 10.

As best shown in FIGS. 10 and 11, the raised flap portion 86 includes a pair of side edges each indicated as 98 extending from the peripheral flange 78 to an inner edge 100 disposed in spaced relationship relative to the centrally disposed projection 82. The reclosable access closure flap 88 is integral with and occupies the major part of the raised flap portion 86.

Figure 13:
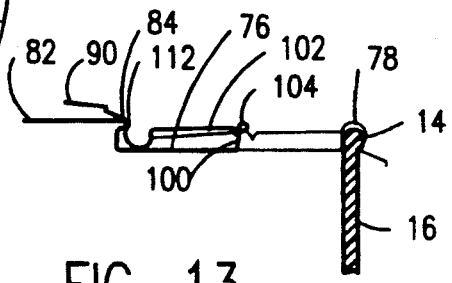
FIG. 13 is a partial sectional elevation of the alternate embodiment of the cup lid taken along line 13—13 of FIG. 11 with the reclosable access closure flap in the fully open position.

The reclosable access closure flap 88 includes a closure flap opening means comprising a plurality of elongated recesses or grooves each indicated as 102 extending inwardly between the peripheral flange 78 to a hinge formed by a depression 104. A bias ramp or ridge 105 is formed on the inner edge 100 between the hinge 104 and the first retainer element or protrusion 84. The bias ramp or ridge 105 is disposed above the hinge 62 in the horizontal plane to bias the reclosable access closure flap 88 in a closing direction when in the fully open position. In addition, the hinge 104 may be disposed below the first retainer element or protrusion 84 in the horizontal plane. The plurality of elongated recesses or grooves 102 strengthens the reclosure access closure flap 88 relative to the remainder of the raised flap portion 86 causing the reclosure access closure flap 88 to separate or tear along a pair of straight converging lines or straight flap access side edges each as indicated as 106. The outer most portion 108 of the peripheral flange flap portion 110 of the reclosable access closure flap 88 may include a retainer recess or groove 112 to releasably receive the first retainer element or protrusion 84 as best shown in FIG. 13. As shown in FIG. 10, a pair of slits each indicated as 114, one formed in the outer concentrically disposed wall 94 on each side of the pull tab 42, are provided to assist in initially forming the reclosable access closure flap 40.

As best shown in FIGS. 12 and 13, the hinge or depression 104 is spaced upwardly from the substantially flat recessed portion 76 near or adjacent the horizontal plane of the first retainer element or protrusion 84.

Except as otherwise described, the alternate embodiment of the cup lid 74, shown in FIGS. 10 through 13, functions in the same manner as the cup lid 24 shown in FIGS. 2 through 9. As shown in FIG. 13, the reclosable access closure flap 88 is substantially parallel to the substantially flat recessed portion 76 when in the open position.

No special materials are required to practice this invention. The lid is suitably made of a relatively inert organic polymer, such as polyethylene or polypropylene, by any suitable method, such as stamping and/or injection molding.

Reclosable lids of the present invention, besides being useful on the exemplified beverage cup, are convenient dispensing covers for other liquids and for granular or powdery materials, such as foodstuffs, chemicals, etc. Variants may be made, as by adding, combining, deleting, or subdividing parts, or steps, while retaining at least some of the advantages and benefits of the invention which is defined in the following claims.

The invention accordingly comprises the features of construction, combination of elements, and arrangement of parts which will be exemplified in the construction hereinafter set forth, and the scope of the invention will be indicated in the claims.

What is claimed is:

1. A cup lid for use with a beverage cup comprising a reclosable access closure flap including a hinge formed on an inner end portion of said reclosable access closure flap, whereby said reclosable access closure flap is selectively movable between a closed and open position, a first retainer element disposed on said cup lid to engage and releasably retain said reclosable access closure flap when in said open position and a bias ramp disposed on said cup lid axially above said hinge and located as to apply an upward force on said reclosable access closure flap when said reclosable access closure flap is in said open position to bias said closure flap toward said closed position.

2. The cup lid of claim 1 wherein said bias ramp is disposed between said hinge and said first retainer element.

3. The cup lid of claim 1 wherein said hinge is disposed axially below said first retainer element.

4. The cup lid of claim 1 wherein said cup lid further comprises a recessed portion having a peripheral flange formed about the peripheral edge thereof to engage the beverage cup and said first retainer element is spaced axially relative to said recessed portion.

5. The cup lid of claim 4 wherein said peripheral flange further includes a pull tab formed thereon.

6. The cup lid of claim 4 wherein an outer portion of said reclosable access closure flap includes a peripheral flange flap portion which releasably engages said first retainer element when said reclosable access closure flap is in said open position.

7. The cup lid of claim 1 wherein said first retainer element comprises a protrusion extending outwardly from a projection extending upwardly from said recessed portion.

8. The cup lid of claim 7 wherein an outer portion of said reclosable access closure flap includes a peripheral flange flap portion which includes a retainer recess formed therein to releasably receive said first retainer element therein when said reclosable access closure flap is in said open position.

9. The cup lid of claim 4 further including a closure flap opening means comprising at least one elongated recess formed in said reclosable access closure flap such that when said reclosable access closure flap is moved from the closed position to the open position said elongated recess defines a pair of substantially straight reclosable access closure flap access side edges.

10. The cup lid of claim 9 wherein said reclosable access closure flap is formed on a raised flap portion formed on said recessed portion.

11. The cup lid of claim 4 further including closure flap opening means comprising a pair of slits formed on opposite sides of said reclosable access closure flap.

12. The cup lid of claim 11 wherein said reclosable access closure flap is formed on a raised flap portion formed on said recessed portion.

* * * * *